US010702890B2

(12) United States Patent
Sosnowski

(10) Patent No.: US 10,702,890 B2
(45) Date of Patent: Jul. 7, 2020

(54) DEVICE FOR SEPARATION AND REMOVAL OF LIGHT IMPURITIES FROM GRANULAR MATERIAL

(71) Applicant: Wlodzimierz Sosnowski, Ciechanów (PL)

(72) Inventor: Wlodzimierz Sosnowski, Ciechanów (PL)

( * ) Notice: Subject to any disclaimer, the term of this patent is extended or adjusted under 35 U.S.C. 154(b) by 0 days.

(21) Appl. No.: 16/093,331

(22) PCT Filed: Apr. 12, 2017

(86) PCT No.: PCT/PL2017/000039
§ 371 (c)(1),
(2) Date: Oct. 12, 2018

(87) PCT Pub. No.: WO2017/179999
PCT Pub. Date: Oct. 19, 2017

(65) Prior Publication Data

US 2019/0126321 A1 May 2, 2019

(30) Foreign Application Priority Data

Apr. 14, 2016 (PL) ..... 416841

(51) Int. Cl.
*B07B 4/04* (2006.01)
*B07B 4/02* (2006.01)

(52) U.S. Cl.
CPC ..... *B07B 4/04* (2013.01); *B07B 4/025* (2013.01)

(58) Field of Classification Search
CPC ..... B07B 4/02; B07B 4/025; B07B 4/04
(Continued)

(56) References Cited

U.S. PATENT DOCUMENTS 3,448,856 A * 6/1969 Thomson ..... B07B 4/04 209/138
6,712,216 B2 * 3/2004 Van Oirschot ..... B07B 7/01 209/138

(Continued)

FOREIGN PATENT DOCUMENTS

| | | |
|---|---|---|
| DE | 1 186 731 B | 2/1965 |
| FR | 2 724 586 A1 | 3/1996 |
| JP | 52-11569 A | 1/1977 |

OTHER PUBLICATIONS

International Search Report dated Jul. 8, 2017, issued in counterpart International Application No. PCT/PL2017/000039 (3 pages).

*Primary Examiner* — Terrell H Matthews
(74) *Attorney, Agent, or Firm* — Westerman, Hattori, Daniels & Adrian, LLP

(57) ABSTRACT

A device for separation and removal of light impurities of a granular material has a body (1) in the upper part of which is located a fan (2) that sucks air, driven by a motor (3), and in the central part is axially fixed a hopper (6) connected to an inlet (7) of the granular material wherein in the lower part of the device is located a module (13) in the shape of a centripetal guide (14) consisting of a cylindrical housing (15) on the internal wall of which are evenly arranged, at a distance from each other, in different transverse planes, directing plates (16) turned with their ends towards the device axis such that the plates (16) in one plane are shifted in relation to the plates (16) in an adjacent plane. Between the hopper (6) and constituting a separate module (13) the centripetal guide (14) with directing plates (16), a module (8) is located in the shape of a cylinder (9) inside which is located a centrifugal guide (10) that has a shape of an axial supporting member (11) on the surface of which in different transverse planes are fixed directing elements (12) turned with their ends towards the internal wall of the cylinder (9).

(Continued)

Figure 1:
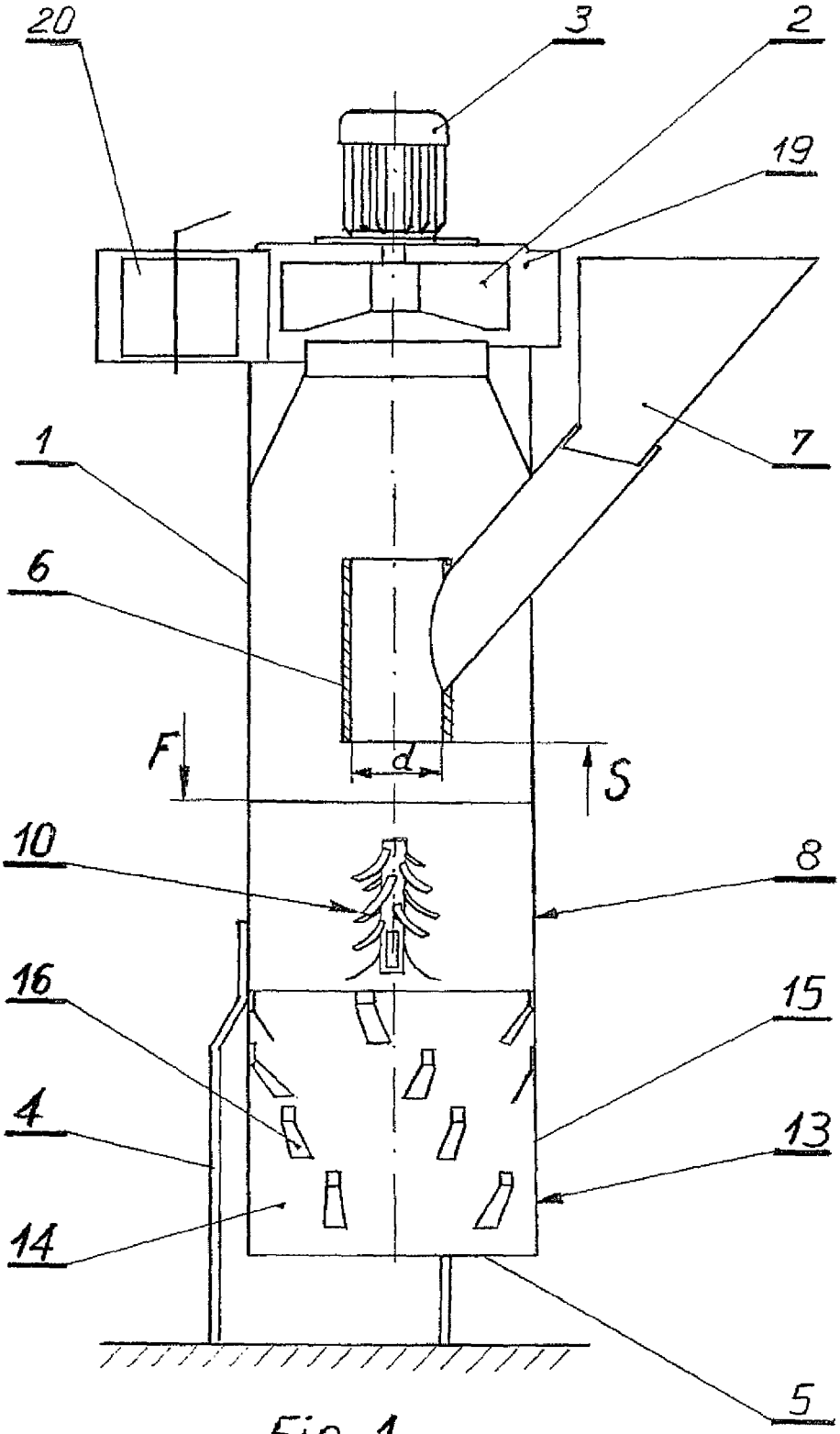

The modules (8) with the centrifugal guide (10) and the modules (13) with the centripetal guide (14) are placed alternately below the hopper (6).

15 Claims, 5 Drawing Sheets

(58) Field of Classification Search
USPC ..... 209/138, 139, 139.1
See application file for complete search history.

(56) References Cited

U.S. PATENT DOCUMENTS

| | | | | |
|---|---|---|---|---|
| 7,021,572 | B2 * | 4/2006 | Heeb | A23N 15/10 241/12 |
| 8,820,535 | B2 * | 9/2014 | Wark | B07B 7/083 209/138 |
| 2011/0132813 | A1 * | 6/2011 | Baetz | B04C 5/12 209/138 |

* cited by examiner

DEVICE FOR SEPARATION AND REMOVAL OF LIGHT IMPURITIES FROM GRANULAR MATERIAL

The present invention provides a device for separation and removal of light impurities from granular material, especially from cereal grains, grass and leguminous plant seeds as well as from plastic granules.

There is known a separator of light impurities for grain of the name of AIR SEED manufactured by German company RIELA. Moreover, there are known aspirators for removal of dust and light impurities from grain of the name of KF 12 and KF 20/40/60 manufactured by Danish company KONG-SKILDE as well as an air separator of the name of PULCO manufactured by Danish company DAMAS. From the description of the Polish patent No. PL 171575 that belongs to the applicant of this invention, is known a device for separation of light impurities from granular material, especially from cereals and leguminous plant seeds. In all of the mentioned purifying devices, light particles or dusts are sucked off by the fan located in the upper part of the cylindrical housing and the pure granular material exits the housing gravitationally through the lower outlet wherein in the separator of RIELA company as well as in the device according to Polish patent No. PL 171575, inside the cylindrical housing below the hopper a horizontal rotary disk is located driven by a motor, on which falls impure grain what causes higher purification efficiency. To improve the purification accuracy of the granular material from light impurities within a broad range of application there was developed a centripetal guide construction of vertical stream of loose material presented in the description of the Polish patent No. PL 214174 that belongs also to the applicant of the present invention. The guide is made of a stationary cylindrical housing on the internal surface of which are evenly arranged at a distance from each other, directing plates in different transverse planes such that the plates in one plane are shifted in relation to the plates of an adjacent plane. The plates are located on the path of the loose material falling under its weight along the housing internal wall in the counter-current of the air stream directed upwards. The plates are deflected from the housing internal surface preferably by the angle of 125°. The plane of the plates can have a rectilinear or curvilinear shape. The directing plates reach with their ends towards the housing interior at the length preferably equal to 0.17 of the housing inside diameter. The plates in one plane occupy at least 0.09 of the housing internal circumference, but they can also be connected with their sides making a continuous surface of an inverted truncated cone side surface. To improve the purification process the guide construction has been modified and its essence presented in the Polish patent No. PL 219396 an additional one to the patent No. PL 214174. In the presented construction a multi-module guide has been used wherein the first module located below the hopper constitutes a unit of two truncated cones connected with bases, fixed in the cylindrical housing below which is a second module in the shape of a cylindrical housing with directing plates as in the main patent. The guide can be built of many alternately fixed modules, the first and the second one.

The goal of the present invention is further improvement of loose material purification efficiency.

The essence of the invention constitutes the device structure for separation and removal of impurities from granular material that has a body in the upper part of which is located a fan sucking air, driven by a motor and in the central part is axially fixed the hopper connected to granular material inlet wherein in the lower part of the device is located a module in the shape of a centripetal guide consisting of a cylindrical housing on the internal surface of which are evenly arranged at a distance from each other, in different transverse planes, the directing plates turned with their ends towards the device axis such that the plates in one plane are shifted in relation to an adjacent plane. According to the invention, between the hopper and the centripetal guide with directing plates constituting a separate module is located a module in in the shape of a cylinder inside which is a centrifugal guide having the shape of an axial supporting member on the surface of which in different transverse planes are fixed directing elements turned with their ends towards the cylinder internal wall. The centrifugal guide can be rotary fixed inside the cylinder constituting a module located under the hopper. The axial supporting member can have a cylindrical surface or constitute a regular polygon in a cross section. The directing elements are preferably fixed to the axial supporting member at equal angular distances from each other in every transverse plane wherein the elements in one plane are shifted in relation to the elements in an adjacent plane by half of the angular distance between the elements. The directing elements can be fixed to the axial supporting member at different angular distances from each other in every transverse plane wherein in such a case the elements in one plane are in the spaces between the elements of an adjacent plane. The modules with centrifugal guide and the modules with centripetal guide are arranged alternately below the hopper. The directing elements are deflected from the axial supporting member surface by an angle not smaller than 26° and not greater than 78° wherein the directing elements can have a rectilinear or curvilinear profile and in the case of the curvilinear ones they are fixed tangentially to the axial supporting member surface. The preferably curvilinear directing elements can have a radial profile of the radium of curvature from 0.07 to 0.25 of the cylinder inside diameter. The ratio of the total surface area of all directing elements, visible in the axial view in all planes, to the hopper interior cross section surface area is from 0.7 to 1.4 whereas the ratio of the directing elements total surface area in one transverse plane to the hopper interior cross section surface area is from 0.0016 to 0.0189, and the ratio of the directing elements total surface area in one transverse plane to the cylinder interior cross section surface area is from 0.0007 to 0.0044. The module outside diameters are similar to each other and respectively similar to the device body outside diameter.

Thanks to use a modular, even many times repeated system of dissipation of the vertical stream of the granular material falling gravitationally, alternately centrifugal and centripetal, an accurate purification off light impurities is obtained with high purification efficiency and, at the same time, damage of the purified material is avoided.

Figure 2:
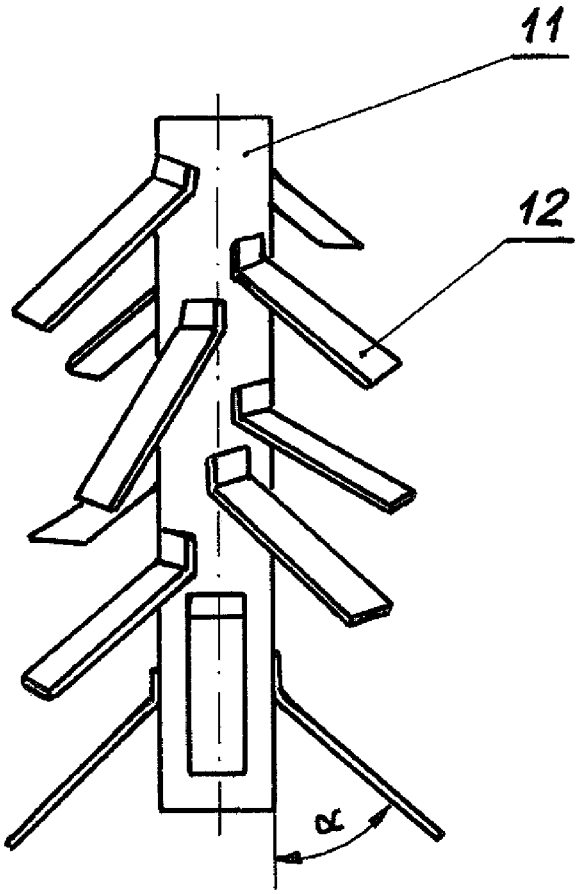
Figure 3:
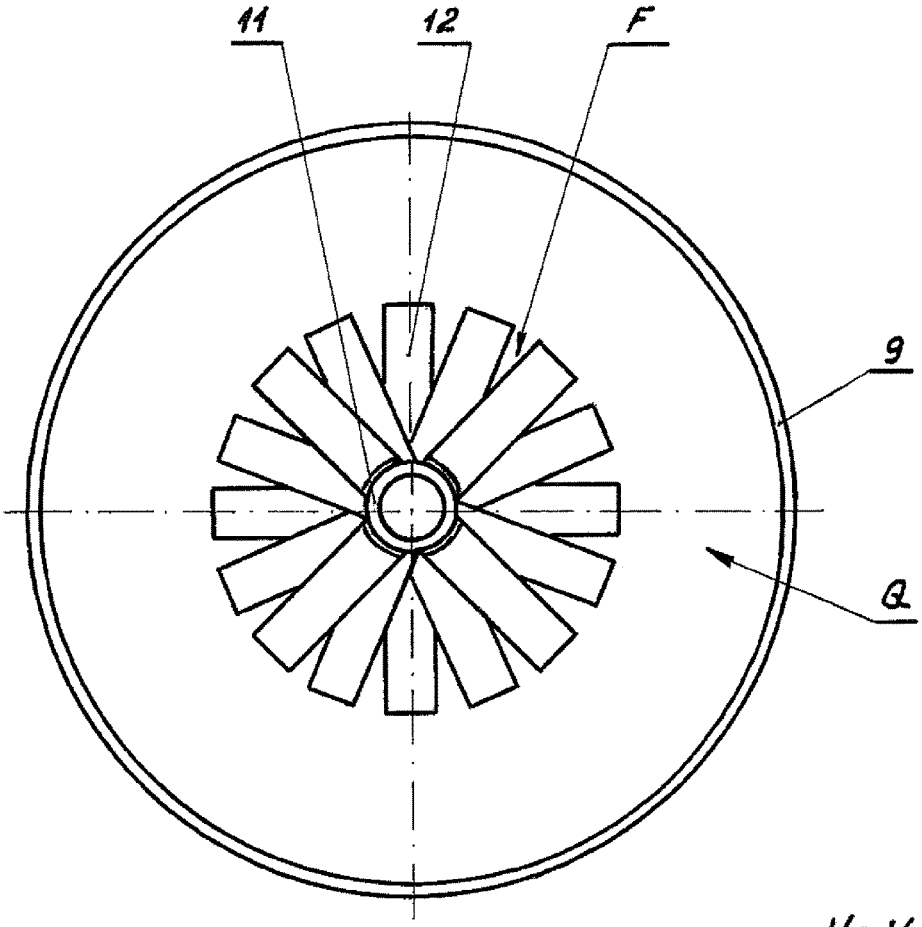
Figure 5:
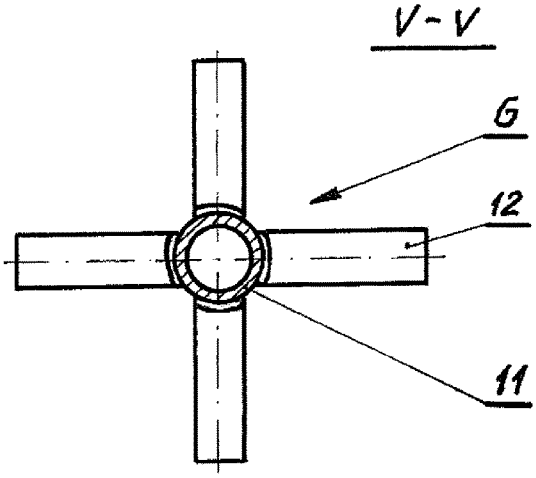
Figure 4:
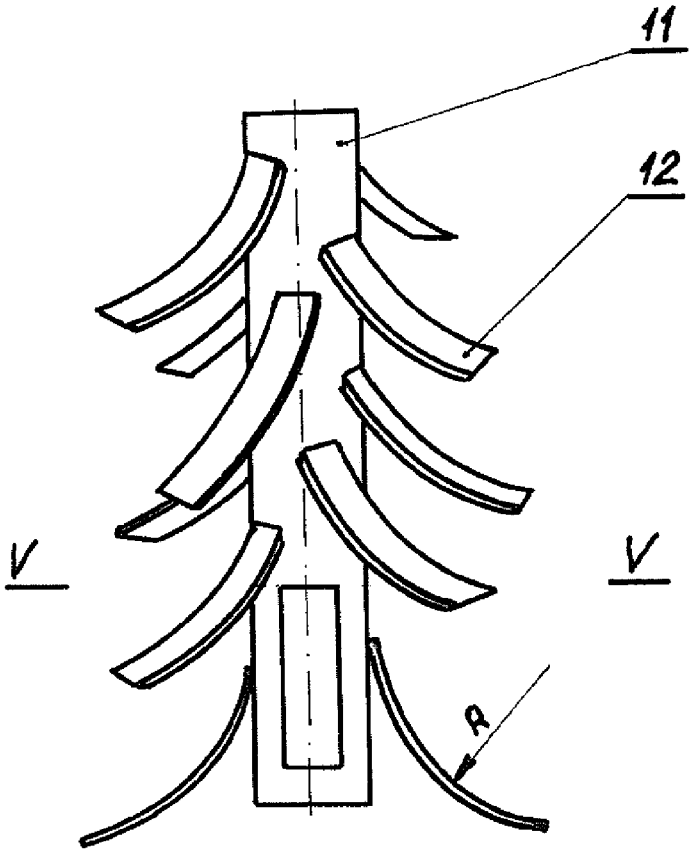
Figure 6:
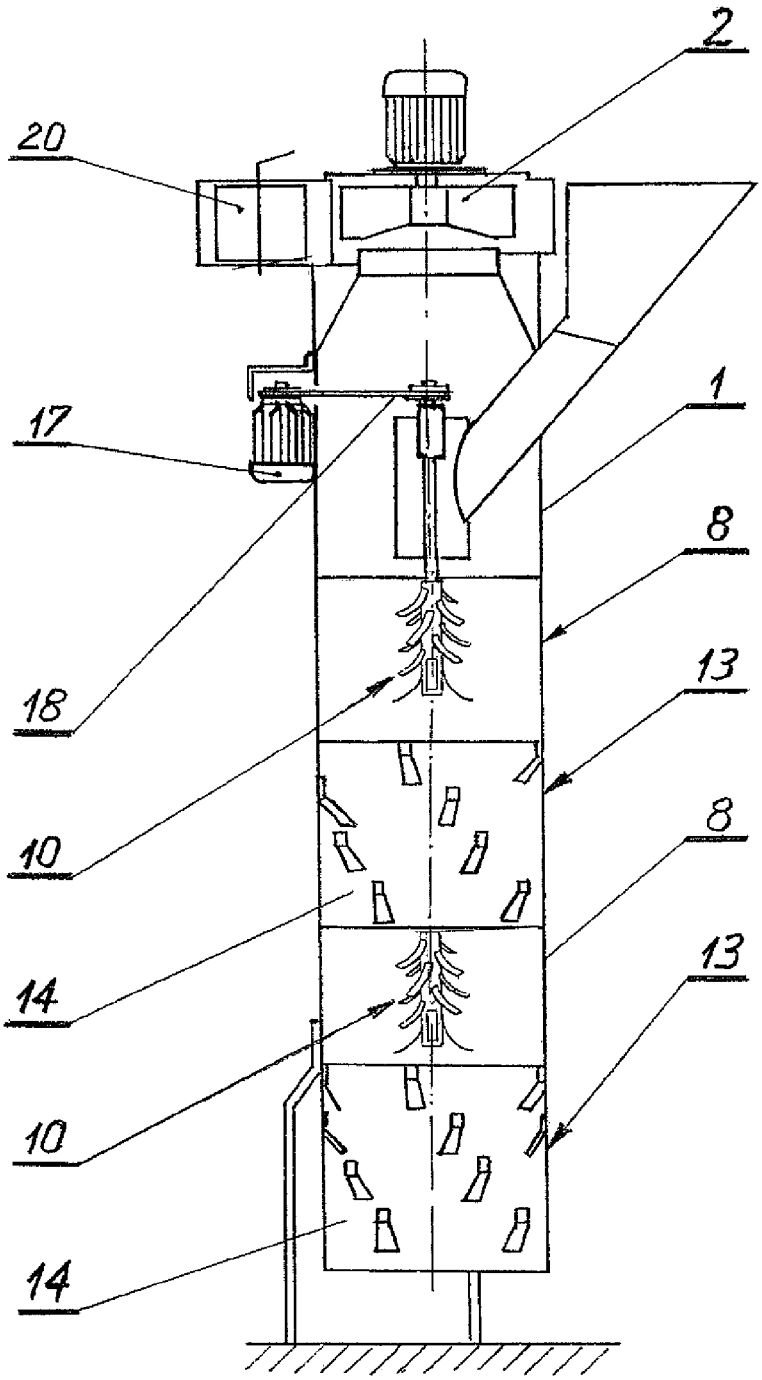

The device according to the invention is visible in embodiments in the drawing in which FIG. 1 shows a schematic presentation of the device in an axial section in which is used one module with a centrifugal guide and one module with a centripetal guide, FIG. 2—the centrifugal guide in a side view with the directing elements of rectilinear profile, FIG. 3—the module with the centrifugal guide in top view, FIG. 4—the centrifugal guide in a side view with the directing elements of a curvilinear profile, FIG. 5—the centrifugal guide in a section according to the line V-V of FIG. 4, and FIG. 6—the device version in a schematic presentation in an axial section in which are used two modules with a centrifugal guide and two modules with a centripetal guide wherein in the upper module a rotary centrifugal guide is used.

The device according to the invention has a cylindrical body 1 in the upper part of which a fan 2 is located that sucks air, driven by means of an engine 3. The body 1 is mounted on the supporting structure 4 so that its end constituting the outlet 5 of the purified granular material and the inlet of the sucked air is above the ground level. Below the fan 2 in the central part of the body is axially mounted the cylindrical hopper 6 connected to the inlet 7 of the granular material. Below the hopper 6 is axially located the module 8 in the shape of the cylinder 9 inside which is the centrifugal guide 10 having the shape of the axial supporting member 11 on the surface of which in different transverse planes are fixed the directing elements 12 turned with their ends towards the cylinder 9 internal wall. The axial supporting member 11 preferably has a cylindrical surface or constitutes a regular prism. The directing elements 12 are fixed on the surface of the axial supporting member 11 at equal angular distances between them in every transverse plane wherein the elements 12 in one plane are shifted in relation to the elements 12 in an adjacent plane by half of the angular distance between the elements 12. Alternatively, the directing elements 12 can be fixed to the surface of the axial supporting member 11 at different angular distances between them in every transverse plane wherein in this case the elements 12 in one plane are in the spaces between the elements 12 in an adjacent plane. The directing elements 12 are deflected from the surface of the axial supporting member 11 by the angle $\alpha$ from 26° to 78°, preferably 45° and can have a rectilinear or curvilinear profile. The directing elements 12 of curvilinear profile are fixed tangentially to the surface of the axial supporting member 11 wherein the preferably curvilinear elements 12 have a radial profile of the radius of curvature r from 0.07 to 0.25 of the cylinder 9 inside diameter d value. The value of the ratio of the total surface area F of all directing elements 12 visible in the axial view (FIG. 3) in all planes, to the hopper 6 interior cross section surface area S is from 0.7 to 1.4 whereas the value of the ratio of the total surface area G of the directing elements 12 in one transverse plane (FIG. 5) to the mentioned hopper 6 interior cross section surface area S is from 0.0016 to 0.0189.

Moreover, the value of the ratio of the mentioned surface area G of the directing elements 12 in one transverse plane, to the surface area Q of the cylinder 9 interior cross section is from 0.0007 to 0.0044. Below the module 8 with the centrifugal guide 10 is mounted the module 13 in the shape of a centripetal guide 14 consisting of a cylindrical housing 15 on the internal surface of which are arranged evenly at a distance from each other, in different transverse planes, the directing plates 16 turned with their ends towards the device axis such that the plates 16 in one plane are shifted in relation to the plates 16 in an adjacent plane. The modules 8 with the centrifugal guide 10 and the modules 13 with the centripetal guide 14 are places alternately below the hopper 6. The outside diameters of both modules 8 and 13 are similar to each other and respectively similar to the device body 1 outside diameter so such that they can be slid over each other. In the version of the device (FIG. 6) is used the module 8 with the centrifugal guide 10 fixed rotary and driven by an additional motor 17 through the transmission 18 wherein such a device can be used to purify sawdust and plastics where there is suspending the purifying material on the directing elements 12 of the centrifugal guide 10. The impurities together with the air sucked by the fan 2 are discharged outside through the outlet duct 19 equipped with the adjusted diagraph 20.

The invention claimed is:

1. A device for separation and removal of light impurities of granular material, comprising:

a body, a fan in an upper part of the device, the fan sucking air and being driven by a motor, a hopper axially fixed in a central part of the device, a granular material inlet connected with the hopper, and a first module in a lower part of the device and comprising a centripetal guide, the centripetal guide comprising a cylindrical housing, and directing plates fixed to an internal surface of the cylindrical housing and being evenly disposed, at a distance from each other, in various transverse planes, wherein ends of the directing plates are directed towards an axis of the device, wherein radial positions of the directing plates in one plane are shifted in relation to radial positions of the directing plates of a neighboring plane, wherein a second module is disposed entirely between the hopper and the first module, wherein the second module is cylindrical and comprises a centrifugal guide, the centrifugal guide comprising an axial supporting member, and directing elements fixed on the axial supporting member in various transverse planes, and wherein ends of the directing elements are each directed toward an internal cylindrical wall of the second module.

2. The device according to claim 1, wherein the centrifugal guide is rotationally fixed inside the inner cylindrical wall of the second module.

3. The device according to claim 1, wherein the axial supporting member has a cylindrical surface.

4. The device according to claim 1, wherein the axial supporting member constitutes a regular polygon in cross section.

5. The device according to claim 1, wherein the directing elements are fixed to the axial supporting member at equal angular distances from each other in every transverse plane, and wherein radial positions of the directing elements in one plane are shifted in relation to radial positions the directing elements in a neighboring plane by half of an angular distance between the directing elements.

6. The device according to claim 1, wherein the directing elements are fixed to the axial supporting member at various angular distances from each other in every transverse plane, and wherein radial positions of the directing elements in one plane are in spaces between radial positions of the directing elements in a neighboring plane.

7. The device according to claim 1, wherein the device comprises a plurality of the first modules and a plurality of the second modules, and wherein the second modules and the first modules are arranged alternately below the hopper.

8. The device according to claim 1, wherein the directing elements are deflected from an axial surface of the axial supporting member by an angle $\alpha$ meeting the condition $26° \leq \alpha \leq 78°$.

9. The device according to claim 8, wherein the directing elements have a rectilinear profile.

10. The device according to claim 8, wherein the directing elements have a curvilinear profile and are tangentially fixed to the axial surface of the axial supporting element.

11. The device according to claim 10, wherein the directing elements have a radial profile of a radius of curvature r meeting the condition $0.07\ d \leq r \leq 0.25\ d$ where d is a diameter of the internal cylindrical wall of the second module.

12. The device according to claim 5, wherein a ratio of a total surface area F of all directing elements in all planes visible in an axial view of the centrifugal guide, to an internal cross sectional area S of the hopper is $0.7 \leq (F/S) \leq 1.4$.

13. The device according to claim 5, wherein a ratio of a total surface area G of the directing elements in one transverse plane to an internal cross sectional area S of the hopper is $0.0016 \leq (G/S) \leq 0.0189$.

14. The device according to claim 5, wherein a ratio of a total surface area G of the directing elements in one transverse plane to an internal cross sectional area Q of the second module is $0.0007 \leq (G/Q) \leq 0.0044$.

15. The device according to claim 1, wherein outside diameters of the first and second modules are similar each other and are respectively similar to an outside diameter of the body.

* * * * *